US005193714A

United States Patent [19]

Carey

[11] Patent Number: 5,193,714

[45] Date of Patent: Mar. 16, 1993

[54] MODULAR VAULT FOR STORAGE TANKS

[75] Inventor: John M. Carey, Ashburn, Va.

[73] Assignee: The Neel Company, Springfield, Va.

[21] Appl. No.: 903,743

[22] Filed: Jun. 25, 1992

[51] Int. Cl.[5] ..... B65D 45/02

[52] U.S. Cl. ..... 220/592; 220/4.09; 220/4.26; 220/4.33

[58] Field of Search ..... 220/592, 581, 4.08, 220/4.09, 4.15, 4.11, 4.16, 4.26, 4.33, 445

[56] References Cited

U.S. PATENT DOCUMENTS

| | | | |
|---|---|---|---|
| 2,033,767 | 3/1936 | Hammer | 220/4.33 |
| 2,433,652 | 12/1947 | Crom . | |
| 2,932,964 | 4/1960 | Dobell . | |
| 3,692,601 | 9/1972 | Goldsworthy et al. | 220/592 |
| 3,889,507 | 6/1975 | Feinberg et al. | 220/4.26 |
| 3,990,035 | 11/1976 | Byers | 220/4.26 |
| 4,045,929 | 9/1977 | Velo Dalbrenta . | |
| 4,074,485 | 2/1978 | Hendriks . | |
| 4,090,632 | 5/1978 | Katzmann et al. | 220/4.26 |
| 4,406,102 | 9/1983 | Kato et al. . | |
| 4,537,328 | 8/1985 | Keesee et al. . | |
| 4,552,166 | 11/1985 | Chadbourne, Sr. et al. . | |
| 4,570,813 | 2/1986 | Weber et al. | 220/592 |
| 4,651,893 | 3/1987 | Mooney . | |
| 4,710,853 | 12/1987 | Reinhardt | 220/4.26 |
| 4,875,361 | 10/1989 | Sharp . | |
| 4,911,326 | 3/1990 | McGouran, Jr. . | |
| 5,033,638 | 7/1991 | Cruver et al. . | |

*Primary Examiner*—Joseph M. Moy
*Attorney, Agent, or Firm*—Dennison, Meserole, Pollack & Scheiner

[57] ABSTRACT

A containment vault for storage tanks formed of substantially duplicate modules arranged in sets of four to encircle a received tank and provide an inwardly directed octagonal support rib assembly. The modules are clamped together to define each set and the sets in turn longitudinally aligned and clamped to define the length of the vault. The opposed ends of the vault are enclosed by bulkheads secured by the module clamping system.

20 Claims, 5 Drawing Sheets

FIG. 1
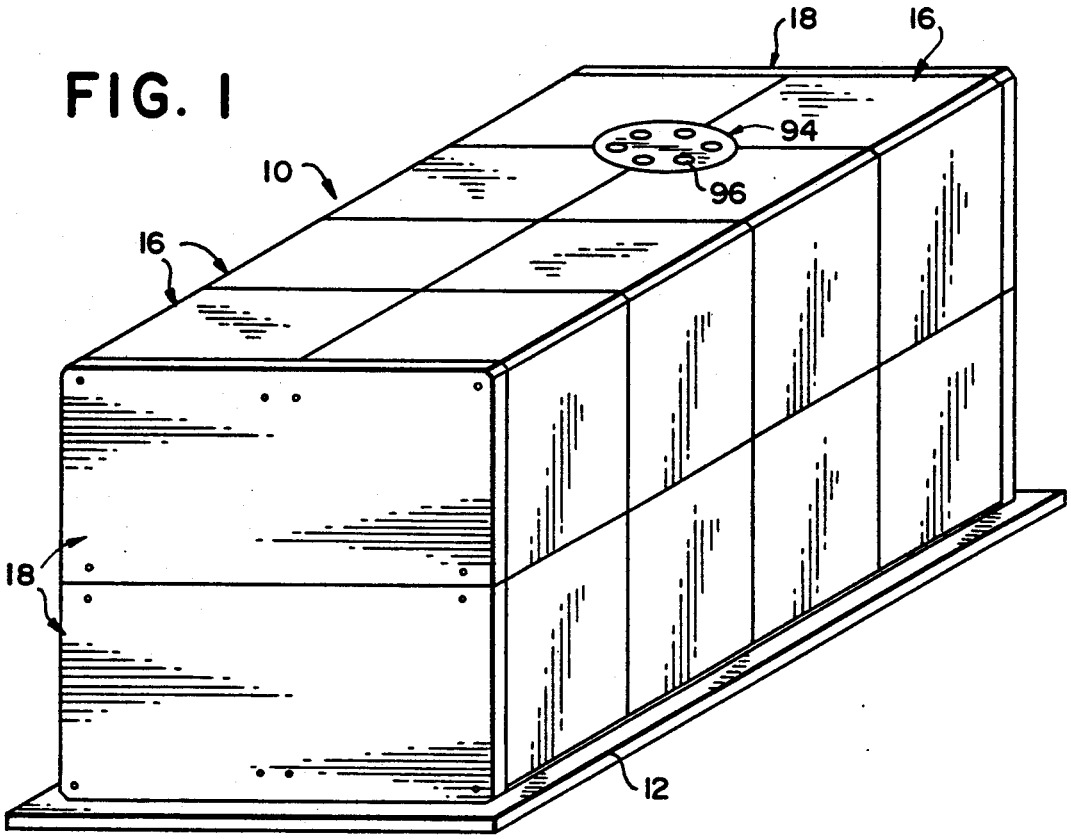
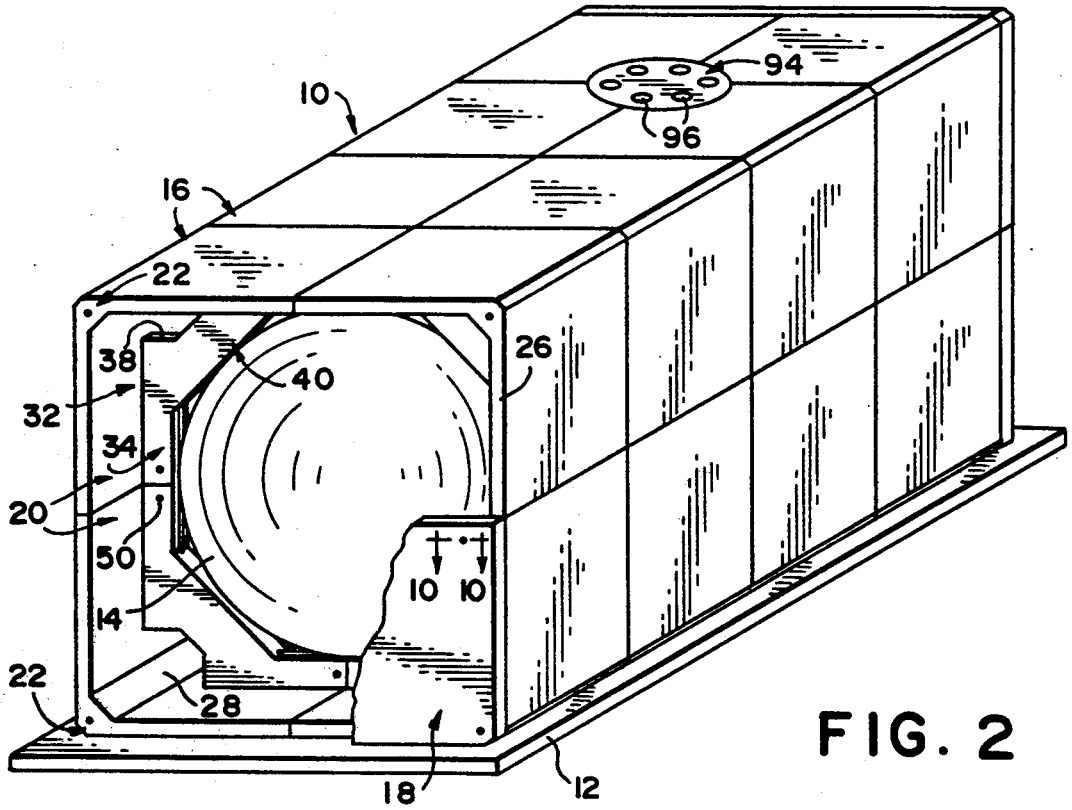
FIG. 2

MODULAR VAULT FOR STORAGE TANKS

BACKGROUND OF THE INVENTION

Tank storage of hazardous materials, for example petroleum products such as gasoline and oil, compressed gas, low level radioactive waste materials, and the like, has until recently involved the use of underground tanks, usually of steel. Such an arrangement was considered the most effective means for the elimination of potential fire hazards, exposure of persons to noxious or otherwise detrimental fumes, spillage and other equally undesirable occurrences.

However, the burying of storage tanks has, of late, been found to be far from the most practical or desirable solution to the problems of hazardous material storage.

The tendency for underground tanks to deteriorate, as by corrosion, and leak over a period of time, when considered with the general inaccessibility of such tanks, requires corrective action which can be excessively burdensome and expensive for the tank owner. This, when coupled with the increased awareness of the fragility of and necessity to protect the environment, has resulted in federal intervention, for example the Resource Conservation and Recovery Act of 1984 which sets forth strict regulations for the monitoring and testing of underground tanks.

In light of the significant problems associated with buried storage tanks, increase consideration has been given to aboveground tanks which are subjected to less stringent restrictions, and which are in turn principally concerned with compliance to state and local fire and safety codes which can be readily met by enclosing the storage tank itself, whether of steel or fiberglass, within a vault. As a preferred example, the vault should be formed with concrete walls at least six inches thick and providing a firewall structure in conjunction with the tank rated at a minimum of two hours at 2000° F.

One proposal to accommodate the requirements of an aboveground storage system is set forth in U.S. Pat. No. 5,033,638, issued Jul. 23, 1991 to Cruver et al. This patent is of particular interest in setting forth the problems associated with in ground tanks, and the desirability of avoiding such problems by providing for aboveground storage.

The solution proposed by Cruver et al includes surrounding the storage tank itself with spaced pairs of vertically continuous semi-circular ribs having spaced upper and lower ends and intimately engaging the circumference of the received tank for the full extent of the ribs. The rib-supported tank is in turn enclosed within a concrete casing formed of upper and lower semi cylindrical shells with integral end walls, the lower shell including two sets of stabilizing legs.

The Cruver et al vault, formed in two precast semi cylindrical sections, includes distinct advantages over vaults formed in situ, including being able to form the sections at a separate manufacturing facility for subsequent transportation to the point of use. While such an arrangement is feasible with regard to smaller standard size tanks, problems with regard to both transportation and handling could be substantial if the Cruver sections were to be made to accommodate tanks of any substantial diameter and length. In this regard, it is to be noted that petroleum storage tanks are currently factory produced in a wide range of sizes, ranging from 500 gallons to 50,000 gallons. Similarly, diameters vary from four feet to twelve feet and lengths can run from 5 feet to 50 feet. The primary limit on a given tank's size is the highway restrictions on truckload freight, including height, width, length and weight. Weight becomes a particularly significant factor when the vault or vault sections, normally formed of 6" thick concrete, are to be transported.

SUMMARY OF THE INVENTION

The invention is concerned with an improved aboveground storage system, and in particular is directed to a concrete vault structure adapted to receive and safely contain a conventional steel or fiberglass storage tank. The vault, as required, will provide a containment vessel which is inherently stable and self standing, and which is leakproof, fireproof, and otherwise so constructed to avoid environmental pollution.

In conjunction with the above features, which are basically essential for aboveground storage, the vault construction of the invention is unique in its adaptability to accommodate tanks of any commercial size, and in particular without regard to the length thereof. Notwithstanding the versatility of the vault construction of the invention in accommodating a wide range of different size tanks, the vaults, and more particularly the components thereof, are precast and shipped to the site of use, thus taking full advantage of a central manufacturing location and the resultant economies.

Another important aspect of the invention is to so form the precast components of the vault of the invention as to accommodate conventional shipping procedures wherein road and rail conditions provide specific width limitations. For example, most factory built storage tanks do not exceed 12 feet in diameter, because of shipping limitations. However, because of the substantially greater width required of a vault to accommodate a tank of this size, the user is faced with the choice of either using a smaller diameter tank which can be accommodated in a vault of the requisite width for road or rail transportation or the actual casting of the vault at the installation site. This problem is avoided in the vault construction of the prevent invention by the utilization of precast modules which align both laterally and longitudinally to define, initially, an upwardly opening cradle adapted to receive the storage tank, and subsequently an overlying duplicately formed multiple module cover.

The width and height of the vault are respectively equal to two modules. As such, modules capable of enclosing the largest practical tank diameters can be easily accommodated to commercial shipping requirements, thus making the use of precast modules practical for substantially any installation. For example, use of modules capable of accommodating 12 foot diameter storage tanks will normally have a width and height of approximately 8 feet 6 inches, thus being easily accommodated by conventional shipping means, notwithstanding that the site assembled vault will ultimately be approximately 17 feet wide and 17 feet high.

The modules, regardless of the width and height thereof, are preferably of a standardized length, for example 5 feet. As such, there is no limit to the length of the vault to be formed, other than that imposed by the length of the tanks or tanks received therein. For example, the 5 foot long modules can define vaults as small as 5 feet long, and as long as 60 feet which is typically the longest trailerable tank length allowed by state restrictions. The modules define a vault which is square in cross section with each module having a pair of right angularly extending equal width legs and a centrally located internal support rib or strut which receives, positions and supports the tank. The rib includes a diagonal brace portion forming an access opening transversely through the rib at the inner corner of the module.

The modules, when positioned, are secured into a unitary structure by tensioned rods and cables, with the joined edges of adjacent modules being sealed against outward discharge in case of tank leakage, providing a thermal barrier, preferably with a minimum of a two hour fire rating in the event of an external fire, providing a waterproof seal to exclude moisture migration into the interior of the vault as might promote corrosion of a steel tank, and providing for transfer of compressive loads from one module to an adjacent module without damage to any of the sealant and insulation means.

The only additional structural components used in the assembly of the vault are end bulkheads which overlie and are cable clamped to the opposed ends of the assembled modules. Each bulkhead is of a width equal to a pair of horizontally assembled modules, and of a height equal to a single module whereby two bulkheads will mount to each end of the vault.

While it is contemplated that the vault structure of the invention be principally used for the accommodation of horizontal storage tanks, with the flat faces of the modules providing a stable support base, it is also contemplated that the modules be assemblable vertically, providing a square enclosure of any desired height. When defining a vertical vault, a slab base, which may actually comprise the above referred to bulkheads, will be provided and the modules stacked thereon with the upper end enclosed by a second pair of bulkheads. Formed in this manner, the vertical vault can be assembled and the tank subsequently lowered therein before a positioning of the upper bulkheads. Alternatively, the vault can be assembled about a vertically positioned tank.

When assembling a horizontal vault, the usual procedure will involve the formation of the lower half of the vault to define an upwardly directed cradle for the reception of the corresponding tank.

Specific objects, advantages, uses and other features of the invention will become apparent as the details of construction and manner of use of the invention are more fully hereinafter presented.

BRIEF DESCRIPTION OF THE DRAWINGS

FIG. 1 is a perspective view of a completely assembled vault in accord with the present invention;

FIG. 2 is a perspective view of the vault with a portion broken away to illustrate the internal positioning of a conventional cylindrical storage tank;

DESCRIPTION OF PREFERRED EMBODIMENTS

Figure 3:
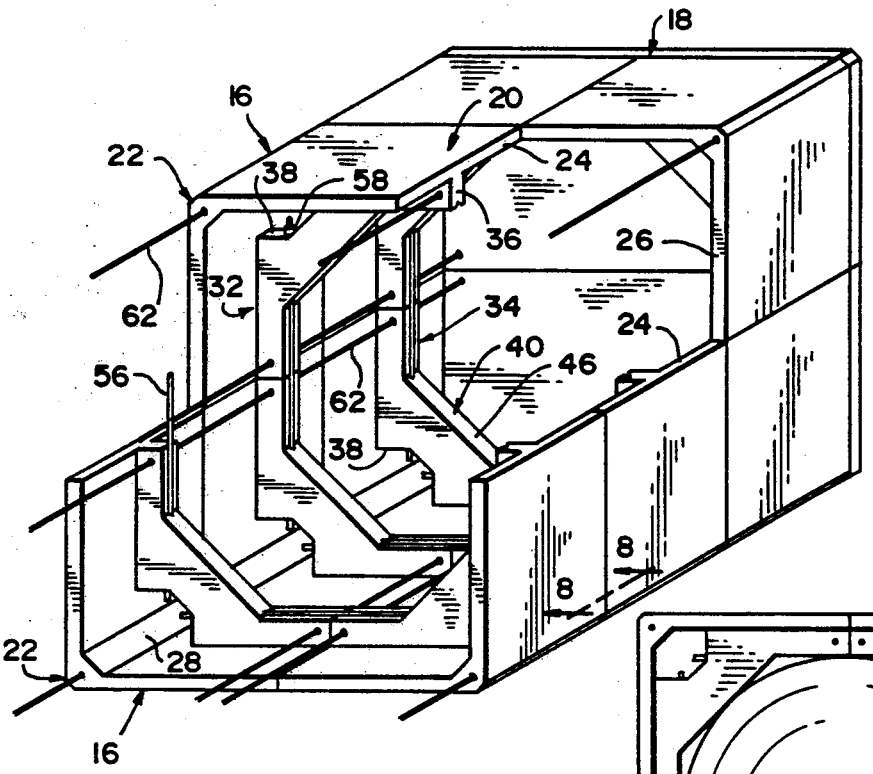
FIG. 3 is a view of the vault with selected portions broken away for purposes of illustration.

Referring now more specifically to the drawings, FIG. 1 illustrates a vault 10 constructed in accord with the present invention and mounted on an appropriate support base 12 which, while preferably a support slab of concrete or the like, can be any flat area. FIGS. 2 and 3 illustrate the vault 10 with sections removed or broken away to illustrate internal details of the assembled vault and placement of a conventional cylindrical steel or fiberglass storage tank 14 therein.

The vault 10 is of modular construction and consists basically of a single form of precast structural module 16 adapted for assembly into a tank receiving storage vault with a width equal to two modules and a length determined only by the length of the storage tank or tanks 14 received therein. The only other structural components utilized are modular end bulkheads 18. Both the module 16 and bulkheads 18 are formed of reinforced concrete, preferably of a minimum thickness of 6".

The basic module 16 is L shaped with legs 20, in the nature of flat panels or panel segments, extending outward from the corner 22 defined therebetween. The legs 20 are of equal width outward from the corner 22 and terminate in substantially flat outer edges 24. Lengthwise, the legs 20, and hence the module 16 itself, terminates in substantially flat side edges 26.

The corner 22 is internally rigidified and enlarged by an integrally cast continuously extending triangular corner block or gusset 28. In precasting the module 16, a continuous cable passage 30 is formed longitudinally along the internally enlarged corner.

A support rib or brace 32 is integrally cast with and centrally along the legs 20 between the opposed side edges 26. The rib 32 includes straight end portions 34, substantially rectangular in cross section and extending from flat outer ends 36 coplanar with the opposed outer ends 24 of the legs 20 to flat inner ends 38 outwardly spaced from the opposed leg and corner block 28. The end portions 34 of the rib 32 are joined by an integrally cast diagonal brace or brace portion 40 extending between the end rib portions 34 adjacent the inner ends 38 thereof. The brace portion 34 includes an outer edge 42, relative to the interior of the module, generally parallel to the corner block 28 and inwardly spaced therefrom to define, with the inner ends 38 of the two rib end portions 34, an access opening 44 transversely through the rib 32 at the corner 22. This access opening 44 provides multiple functions including defining a passageway for the free flow of leakage for detection purposes, should the storage tank 14 fail, providing for physical passage through the vault by a workman or inspector should this be necessary after a positioning of the storage tank 14, and providing access for the manipulation of the mechanical means utilized in uniting the modules 16 when forming the vault at the point of use as shall be explained subsequently.

Figure 4:
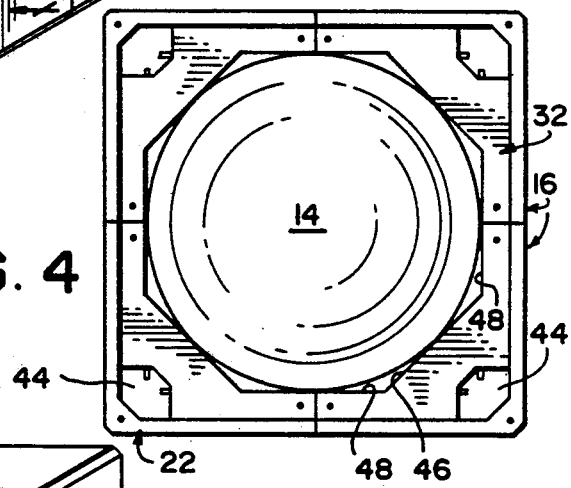
FIG. 4 is an end view of a vault with the bulkheads removed.

The inner edge 46 of the brace 40 is planar, extends at an angle of 45° to the horizontal, and defines a support surface for a received tank 14. Similarly, the inner edges 48 of the end portions 34 of the rib 32 are substantially planar, parallel the adjacent legs 20, and define support surfaces for engagement of the storage tank 14 thereagainst. As will be recognized, the support edges 48 extend from the opposed ends of the brace support edge 46 at included angles of 135° whereby an assembled closed section of four modules will define a continuous inner octagonal support surface. In order to equally engage about a received storage tank 14, note FIG. 4, the length of each support edge 48 is approximately one half that of the brace support edge 46 therebetween whereby, upon an alignment of the corresponding legs 20 of two laterally adjacent modules 16, the combined lengths of the outer rib portion support edges 48 will approximately equal that of the brace support edges 46.

In order to accommodate the mechanical means utilized to unite the assembled modules into a unitary structure, each end portion 34 of the rib 32, inwardly spaced from the outer end 36 thereof is provided with a transverse cable receiving passage 50 therethrough.

As a further means for accommodating cable or rod tying means, the inner support surface 48 of each rib end portion 34 includes a central channel 52 longitudinally therealong commencing at the outer end 36 and extending as a longitudinal bore through the joinder area between the intermediate brace portion 40 and the end portion 34 to open through the inner end 38 of the corresponding end portion.

The modules 16, in defining a protective enclosure for a storage tank 14, are assembled to form square sections of a width and height in accord with the diameter of the tank to be received therein. The number of such square sets of modules, or the longitudinal extent of the vault, is defined by the length of the received tank. The modules 16, being symmetrical, can individually be positioned in any of the four basic positions, that is as left or right bottom or cradle-forming modules or left or right upper or cover forming modules. The planar nature of the module legs 20 define, in the forming of the lower portion of the vault 10, a flat support base. Similarly, the defined vault will include planar sides should one desire to position multiple vaults immediately adjacent one another, and a planar or flat top in the event, albeit remote, that a vertical stacking of the vaults is desired.

Figure 5:
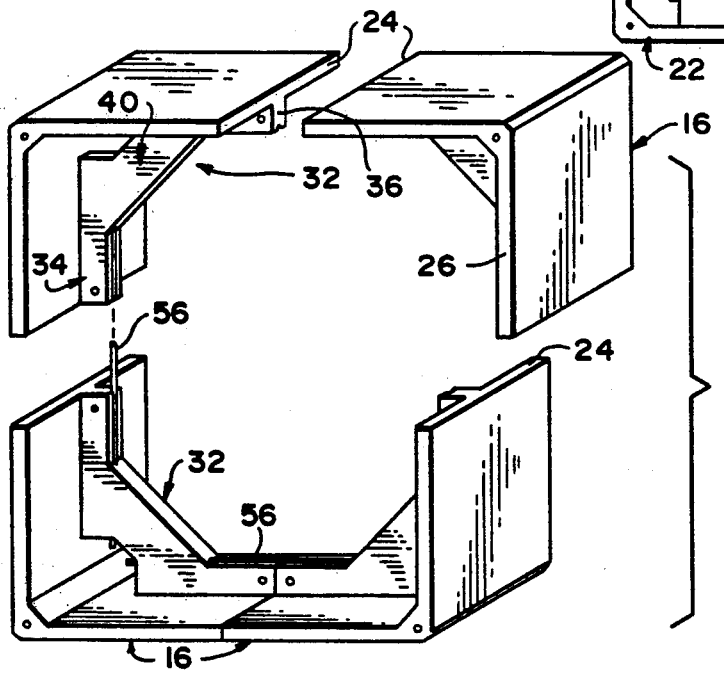
FIG. 5 is a perspective view of four modules positioned to define a rectangular unit with two modules assembled and two modules exploded.
Figure 6:
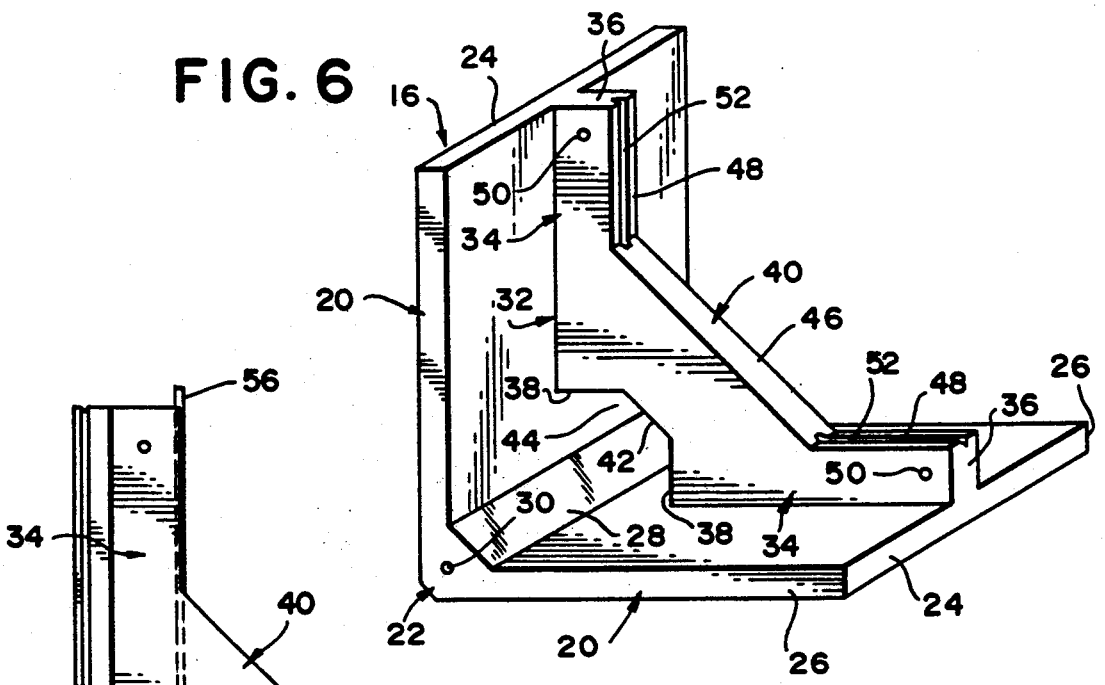
FIG. 6 is a perspective view of a single module.

In assembling the precast modules 16 to define a vault 10, the usual procedure will be to form the lower half of the vault, as suggested in FIG. 5, to define a cradle to receive and support the storage tank 14. The formation of the cradle can be effected either by separately positioning the individual modules in longitudinal and transverse alignment, or by an on site preassembly of two transversely aligned modules as a unit for longitudinal alignment with similar previously formed units.

Figure 7:
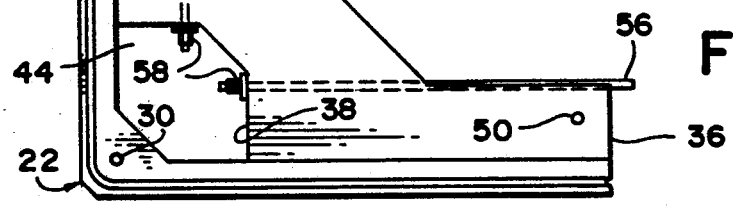
FIG. 7 is an enlarged elevational view of a single module.

Each pair of transversely aligned lower modules 16 have the outer edges of the bottom or horizontal panels 20 thereof in abutting engagement, as are the outer ends 36 of the horizontal end portions 34 of the centrally located ribs 32. The transversely aligned modules 16 are mechanically tied together by transversely extending tensioned cables or rods 56 nested within the aligned cable grooves 52 and corresponding bores. The opposed outer ends of the cable 56 extend into the opposed access openings 44 beyond the corresponding inner ends 38 of the lower rib end portions 34 a sufficient distance as to accommodate an anchoring assembly, normally comprising an appropriate nut and washer combination 58. Noting FIG. 7 in particular, the actual width of the inner end 38 of the rib end portions 34 will be slightly deeper than the outer ends 36 thereof to accommodate and provide a flat bearing surface for the anchor assembly 58. The access openings 44 also provide space for such equipment as will be required to tension the horizontal clamping rod 56.

Depending upon the particular manner of positioning the transversely aligned lower modules, the clamping rod 56 can be of one piece with the rod introduced through each of the corresponding passages 52 as the modules are respectively brought toward each other. Alternatively, the rod 56 can be of two pieces, each individually mounted within the corresponding module and subsequently centrally joined by an appropriate coupler or coupling means as the modules are positioned in edge to edge engagement. The open channels 52 which receive the rods 56 are of a depth so as to position the rod generally below the corresponding support surfaces 48, and facilitate a positioning of the rods and an alignment of the inner ends thereof if a rod coupler is to be used.

The upper or cover defining modules are similarly rod-clamped both to each other and to the vertical legs 20 of the lower modules. In other words, the above described clamping procedure and means is utilized between each pair of adjacent modules 16.

Figure 8:
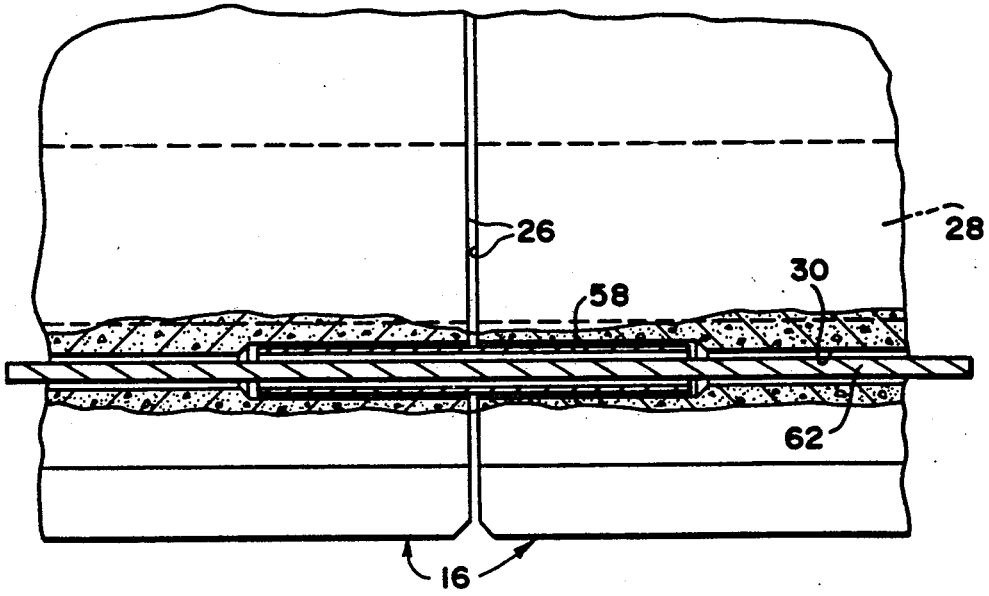
FIG. 8 is an enlarged cross sectional detail taken substantially on a plane passing along line 8—8 in FIG. 3 and illustrating a typical corner alignment means between longitudinally adjacent corners of adjacent modules.

The length of the vault 10 is defined by positioning each module 16 in abutting alignment with the longitudinally adjacent previously positioned module 16. Noting FIG. 8, alignment of the longitudinally adjacent modules is facilitated by the utilization of elongate hollow rigid alignment pins 58 engageable within the adjacent ends of the corner cable bores or passages 30. When the desired vault length is reached, clamping cables 62 are extended through the aligned corner bores 30 and transverse rib passages 50, and the end bulkheads 18 are positioned. As will be appreciated from the drawings, the bulkheads 18 are also modular and of a height equal to that of one module 16 and a width equal to that of two modules whereby a single bulkhead will define a closure panel for each end pair of transversely aligned modules. Thus, each formed vault 10 will require two vertically aligned bulkheads at each end thereof.

Figure 10:
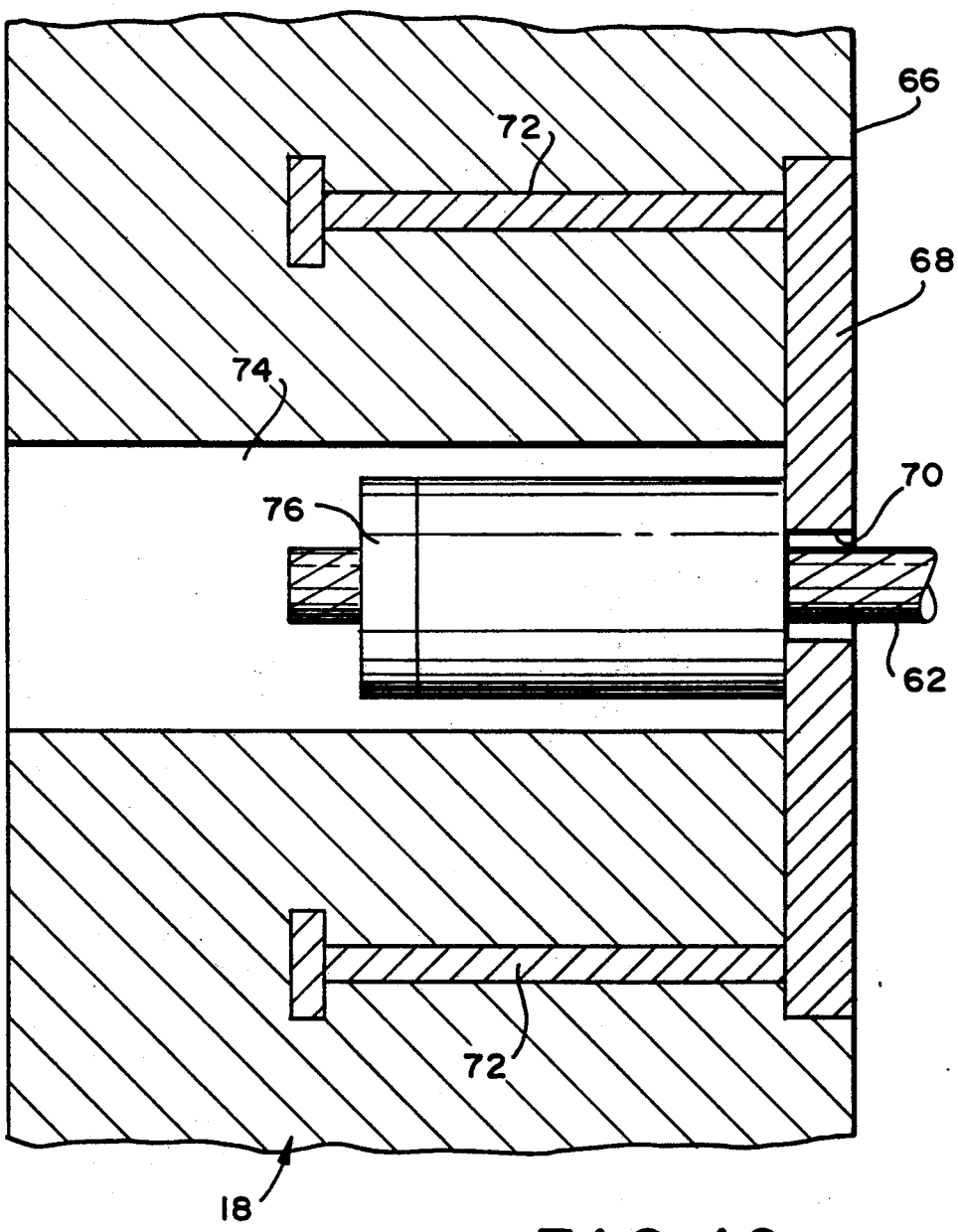
FIG. 10 is an enlarged cross sectional detail taken substantially on a line passing along line 10—10 in FIG. 2 and illustrating a typical bulkhead cable anchoring system.

Noting the detail illustration of FIG. 10 in particular, each bulkhead 18 has, embedded flush with the inner face 66, a steel anchor plate 68 having a central cable aperture 70 therethrough. The plate 68 is anchored within the bulkhead 18 by cast in place anchor studs 72 welded to the anchor plate 68. One such anchor plate is provided for alignment with each outer end of each cable 62. The bulkhead 18 is provided with an enlarged bore 74 therethrough in alignment with the plate aperture 70 for the accommodation of both the corresponding end of the cable 62 received through the aperture 70 and appropriate cable tensioning and anchoring means 76 of conventional design. It is contemplated that after an appropriate pre tensioning of the cables 62, the bulkhead bore 74 will be filled with grout to protect the cable end and provide a finished appearance to the exterior of the bulkhead 18.

As previously noted, in order to maintain the integrity of the vault, it is essential that all of the abutting generally planar edges of the modules be appropriately sealed to properly contain any internal spillage or leakage, provide a positive thermal barrier in case of an external fire adjacent the tank, normally required to be minimum of a two hour fire rating by code, and to provide a or waterproof seal to prevent inward migration of rain or other precipitation as might accumulate within the vault and promote corrosion of the storage tank itself. It is also of course essential that there be an appropriate transfer of compressive loads from one module to the other without damage to the various sealants provided.

Figure 9:
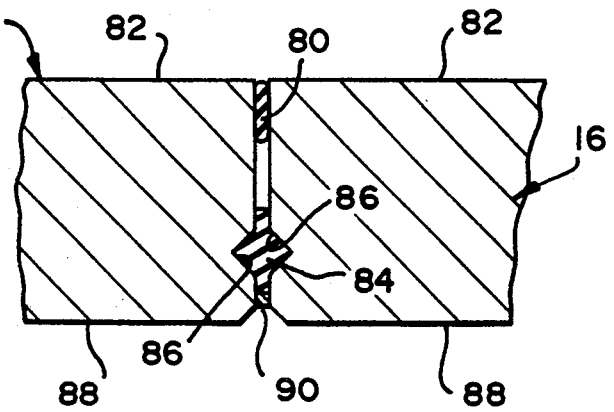
FIG. 9 illustrates the sealing system between adjacent module edges.

Noting the detail illustration of FIG. 9 in particular, the typical edge to edge joint illustrated therein includes a leakage seal 80 of an appropriate material resistant to oils, gasolines, fuels, and hydrocarbon solvents such as Conseal 440. Prior to compression, a 1" bead of this material will be placed between the edges immediately adjacent the interior surface 82 of the adjacent modules.

Fire protection is provided by a fire resistant gasket 84 in the nature of a square strip of ceramic fiber felt material positioned within a pair of opposed shallow V-shaped grooves 86 formed in the opposed facing edges during the casting of the modules. The gaskets are located closer to and inwardly spaced from the exterior module surfaces 88. It is contemplated that the grooves on the module end edges 24 be slightly offset from the grooves 86 on the module side edges 26 to allow for a continuation of the gaskets to the extreme ends of the various edges. The gaskets 84 provide the required fire protection and prevent damage to the internal leakage seal 80 from external sources of heat.

The final sealing function, that of providing a weatherproof joint, is provided by a bead 90 of silicone caulk placed on a backer rod. This material is preferably placed after the modules are assembled and the joints tightened, thus constituting a finishing operation. The silicone seal 90 will provide a weather resistant function not expected to withstand a fire or the like. Should the caulk 90 be destroyed, as by a fire which is in turn effectively excluded by the internal fire resistant gasket 84, the weather excluding integrity of the vault can be reestablished by merely replacing the caulk 90.

It is contemplated that the combination of the three forms of sealant effectively cooperate in accommodating and transferring compressive forces between adjacent modules. It is anticipated that the final joint width will be between ⅛" and ¼" wide. While not illustrated, a similar joint assembly will be provided between each bulkhead 18 and the adjoining side edges 26 of the endmost modules.

With reference to FIG. 2 in particular, the storage tank 14 will incorporate service and vent lines which will have to be accessible from the exterior of the vault 10. While individual access openings or ports can be cut through or formed within selected ones of the module legs for each such line, it is preferred that a single circular access panel 94 be utilized. As illustrated, the access panel, which can be provided with line accommodating ports 96 therethrough and can be removable, is accommodated within a single vault opening preferably formed at the meeting corners of four coplanar legs of four adjacent modules 16. While such an opening can be cut in the leg panels either before or after assembly, the opening will preferably be formed by a minor modification in the structure of the basic form used to precast the modules. Such a modification will probably entail no more than the incorporation of a removable arcuate form board to define that portion of the opening corresponding to the particular module. It will be appreciated that the modules are still, effectively, substantial duplicates of the remaining modules. As will be recognized, the access panel 94 can be provided through any surface of the vault, including the bulkheads 18.

Figure 11:
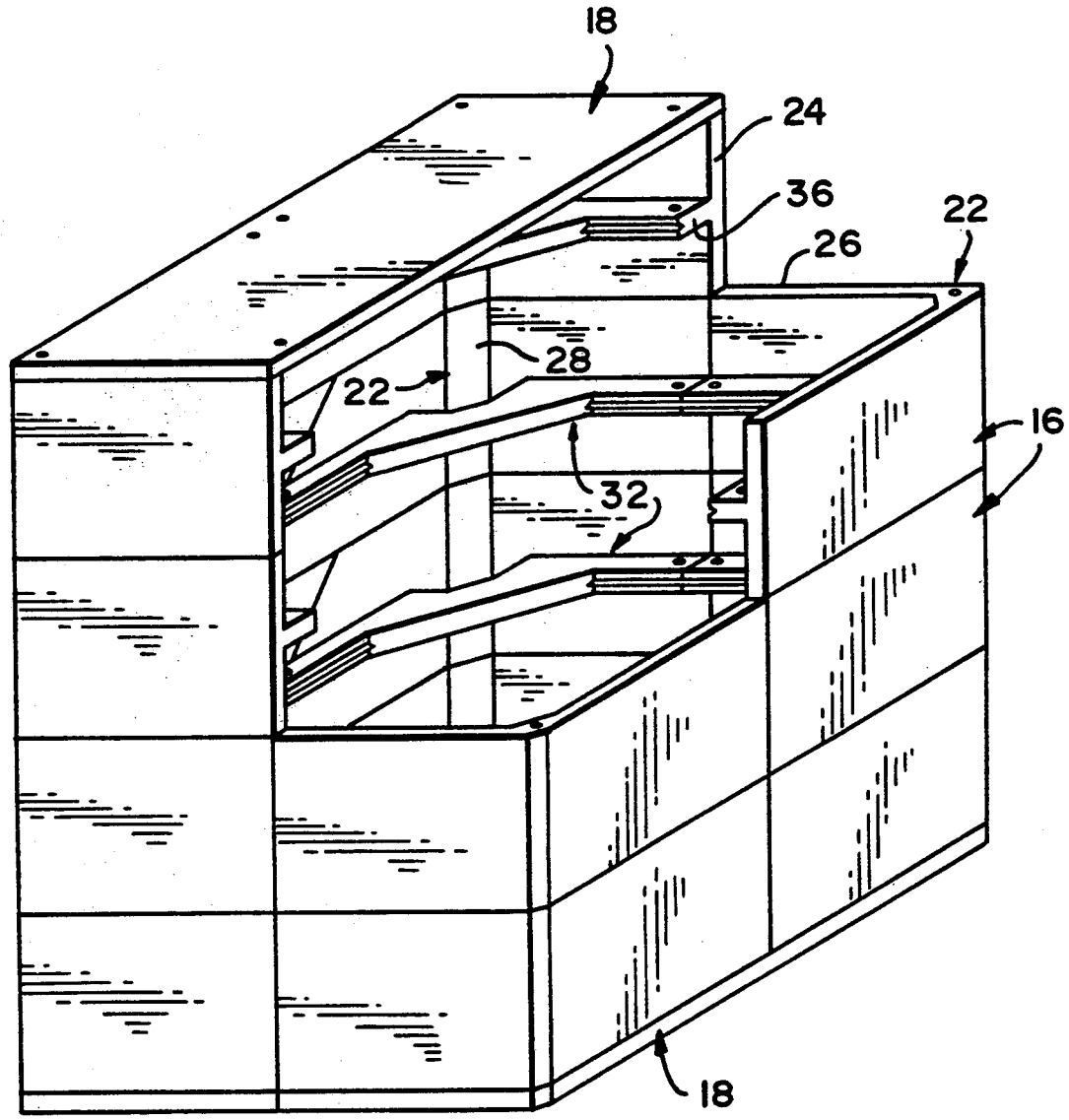
FIG. 11 is a perspective view, with portions broken away, of a vertical installation of the modular vault.

With reference to FIG. 11, the vault 10 can be vertically oriented on a flat base which may comprise the two end bulkheads 18 The structural components, more particularly the modules 16, are the same modules utilized in the above described horizontal vault, and similarly embrace, support and protectively enclose a received storage tank, differing only in the vertical positioning of the received storage tank and the stacked assembly of the modules 16. The upper end of the vertical vault will be appropriately sealed by overlying bulkheads 18. The actual assembly procedure can proceed in several ways, including an initial vertical positioning of the storage tank and the assembly and clamping of the modules thereabout. Alternatively, a lower rectangular section of modules can be assembled with the vertical tank subsequently inserted therein and stabilized by the lower section as the remaining modules are stacked and clamped. In each instance, the modules are to be sized to accommodate the diameter of the received tank with the tank engaged at eight equally spaced points thereabout by the inner support edges of the ribs.

Turning again to the horizontal vault, it is preferred that the modules for any particular vault be sized so as to receive the storage tank in a manner whereby the storage tank is engaged, by each set of modules, at eight equally spaced points thereabout by the inner edges of the ribs and the eight edge lengths which define the octagonal configuration. As tank diameters are pretty much standardized, for example varying in one foot increments from 4 feet to 12 feet, the module sizes can also be easily standardized to accommodate the tanks. It is also of interest to note that the octagonal internal supports will accommodate smaller tank diameters, if necessary under particular circumstances, by the utilization of appropriate blocking wedges mounted to the ribs symmetrical about the tank. Such an arrangement might be particularly desirable should it be necessary to align multiple different diameter tanks within a single vault.

As previously noted, the modular construction of the vault of the invention enables the formation of vaults of any length. In regard thereto, while the width of the modules will differ for different diameter tanks, it is contemplated that the length of the modules preferably remain at approximately 5 feet, thus enabling the formation of vaults of lengths in increments of 5 feet, and also, and importantly, maintaining the size of the modules appropriate for transportation from the manufacturing site to the installation site regardless of the ultimate size of the vault to be formed.

The walls of the vault, and hence the leg panels of the modules, are preferably of a minimum thickness of 6". The ribs are preferably of a minimum depth of 12", thus providing an interior space of at least 12" about a received tank. This interior space between the tank and the vault walls, if desired, may be filled with an inert granular material, for example expanded shale, crushed glass aggregate, and the like. Such material would provide a more uniform support for the tank, which may be important if a fiberglass tank is utilized.

Such a filling could also be used to provide an added layer of insulation for enhanced fire resistance, and to reduce temperature swings and reduce the tendency for development of condensation which in turn could lead to pitting corrosion in steel tanks.

The use of denser material such as sand or pelletized iron ore as the filler in the void space could provide radiation shielding, thus allowing the use of the storage system for low level radioactive waste or the like.

It will be appreciated that, in the assembled vault, all of the fastening devices, that is the cables, rods, and end mounted tensioning components, are located within the vault for protection thereof from the elements. As previously noted, the ends of the bulkhead mounting cables are received within bores which are subsequently sealed by grout. While this effectively protects the cable ends should disassembly of the vault be required, or access to the interior thereof which cannot be achieved by the access panel, the protective grout can be readily removed and one or more end bulkheads removed. Should replacement of the entire storage tank be required, the modules can merely be disassembled and subsequently reassembled about the new tank, thus providing substantial economies in materials and related costs.

It is also to be recognized that the terms "cables" and "rods" are used interchangeably and in their broadest sense to designate any appropriate elongate wire like members capable of being engaged through the structural components and tensioned.

The foregoing is considered illustrative of the principal features of the invention, and as modifications and variations, within the scope of the invention, may occur to those skilled in the art, it is not desired to limit the invention to the exact construction and manner of use shown and described. Rather, all suitable modifications and equivalents may be resorted to falling within the scope of the invention as claimed.

I claim:

1. For use in the construction of a containment vault for an above ground storage tank; the invention comprising multiple rigid modules adapted for assembly to form an internal chamber for the protective enclosure of a storage tank therein, each of said modules including a pair of panel segments extending at generally a right angle to each other and defining a corner therebetween, said panel segments terminating in free outer edges, said vault comprising at least one set of four of said modules positioned with said outer edges of each module sealingly engaging said outer edges of a pair of adjacent modules to encircle an area and form said internal chamber, each of said modules including an internal rib fixed to said panel segments and extending inwardly thereof, said internal rib including a brace portion extending obliquely between said panel segments across said corner defined therebetween, said brace portion including a substantially planar inner support edge within said chamber in inwardly spaced relation to and diagonally across said defined corner whereby four such support edges are provided about said formed internal chamber of said set of four modules for engagement with and support of a received storage tank, joinder means for fixing said modules relative to each other with said outer edges sealingly engaged, said modules including opposed substantially planar side edges defining, in said at least one set of four modules, opposed continuous side edges which in said vault define opposed ends, and bulkhead means adapted to overlie and mount to said opposed ends to enclose said formed internal chamber.

2. The construction of claim 1 wherein said brace portion of each module is inwardly spaced from said defined corner to form an access opening transversely of said brace portion and a flow path for the accommodation of potential leakage from a received tank.

3. The construction of claim 2 wherein each internal rib includes opposed elongate end portions extending from said brace portion to said outer edge of each panel segment, said elongate end portions including substantially planar inner support edges for engagement with and support of a received storage tank in conjunction with the support edge of said brace portion between said opposed elongate end portions.

4. The constructions of claim 3 wherein said modules are substantial duplicates of each other, said panel segments of each module being planar, of equal width from said defined corner therebetween to said outer edges, and of equal length between said opposed side edges.

5. The construction of claim 4 wherein said support edge of each rib end portion is approximately one half the length of said support edge of each brace portion whereby each set of four modules defines an equilateral octagonal support about the interior of said set.

6. The construction of claim 5 wherein said joinder means includes wire-like tension members adapted to engage between transversely adjacent modules of said set, said ribs including means for receiving and mounting said wire like members for a tensioning of said wire like members in a manner adapted to transversely inwardly draw said modules toward each other.

7. The construction of claim 6 including longitudinally extending wire passages defined through each module for the accommodation of longitudinal wire like members therethrough for a tensioned clamping of multiple longitudinally aligned sets of modules to each other.

8. The construction of claim 7 wherein said bulkhead means comprises means for mounting and tensioning the ends of said longitudinal wire like members.

9. The construction of claim 8 including seal means for sealing said outer edges of adjacent modules to each other, said seal means comprising a fire resistant gasket, a leakage seal resistant to tank stored materials and positioned inward of said gasket relative to said defined internal chamber, and a weather resistant seal positioned outward of said gasket relative to said defined internal chamber.

10. The construction of claim 1 wherein each internal rib includes opposed elongate end portions extending from said brace portion to said outer edge of each panel segment, said elongate end portions including substantially planar inner support edges for engagement with and support of a received storage tank in conjunction with the support edge of said brace portion between said opposed elongate end portions.

11. The construction of claim 10 wherein said support edge of each rib end portion is approximately one half the length of said support edge of each brace portion whereby each set of four modules defines an equilateral octagonal support about the interior of said set.

12. A precast concrete module used in the construction of a modular containment vault for above ground extending at approximately right angles to each other and having inner edge portions integrally joined to define a corner, said panels, outward of said corner, terminating in free outer edges, said panels being longitudinally elongate and having opposed side edges, a support rib centrally between said opposed side edges of said panels and extending inwardly from said panel outer edges toward said corner, said rib including a diagonal brace portion transversely across said corner, said rib, including said brace portion, defining inwardly directed support edges.

13. The module of claim 12 wherein said brace portion is inwardly spaced from said defined corner whereby a passage is formed along said corner transversely through said rib.

14. The module of claim 13 wherein said rib includes end portions extending from said brace portion to said outer edge of each panel, each end portion terminating in an outer end at the corresponding outer panel edge and having an inner end at said brace portion, and passage means extending longitudinally along each end portion between said outer and inner ends thereof for the accommodation of a module positioning wire.

15. The module of claim 14 including a longitudinally extending passage defined through said corner and opening through said opposed side edges of said module.

16. The module of claim 15 wherein each of said module panels is planar with substantially flat inner and outer faces.

17. A modular vault for storage tanks, said vault comprising multiple substantially duplicate rigid modules assembled to form a chamber for protective enclosure of a storage tank therein, each of said modules including a pair of integral panels extending at a substantially right angle to each other and terminating in free outer edges, said modules being assembled in multiple sets of four modules with each set of four modules forming a rectangular configuration with the outer edges of each of said modules of said set sealed to the outer edges of two adjoining modules, said multiple sets of modules including opposed side edges and being aligned with the side edges of adjacent sets sealed to each other, bulkhead means engaged over said side edges of the outermost sets, and wire like tension members for maintaining the modules of each set in assembled relationship, and said multiple sets and bulkheads in assembled relationship.

18. The vault of claim 17 wherein each module includes an inwardly projecting rib transversely therealong between said free outer edges, said ribs of said modules of a set extending continuously about the interior of said set and defining a continuous support edge.

19. The vault of claim 18 wherein said defined support edge comprises eight substantially equal linear extents for equal spaced supporting engagement with a cylindrical tank received therein.

20. The vault of claim 19 wherein each of said ribs includes passages both longitudinally and transversely therethrough, said wire-like members being engaged through said passages for a tensioned joinder of said modules.

* * * * *

UNITED STATES PATENT AND TRADEMARK OFFICE

CERTIFICATE OF CORRECTION

PATENT NO. : 5,193,714

DATED : March 16, 1993

INVENTOR(S) : John M. Carey

It is certified that error appears in the above-identified patent and that said Letters Patent is hereby corrected as shown below:

Column 4, line 25; "tank receiving" should be --tank-receiving--.

Column 9, line 25;

Column 10, lines 28, 29, 33 and 39; and

Column 12, line 10; "wire like" should be --wire-like--.

Column 10, lines 20 and 57; "one half" should be --one-half--.

Column 10, line 43; "tank stored" should be --tank-stored--.

Column 10, line 62; after "ground" insert --storage tanks, said module comprising a pair of panels--.

Signed and Sealed this

Thirtieth Day of November, 1993

*Attest:*

*Attesting Officer*

Bruce Lehman

BRUCE LEHMAN

*Commissioner of Patents and Trademarks*